US009278516B2

(12) United States Patent
Masunaga

(10) Patent No.: US 9,278,516 B2
(45) Date of Patent: Mar. 8, 2016

(54) IMAGE FORMING APPARATUS

(71) Applicant: Suguru Masunaga, Kanagawa (JP)

(72) Inventor: Suguru Masunaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/640,804

(22) Filed: Mar. 6, 2015

(65) Prior Publication Data

US 2015/0258822 A1 Sep. 17, 2015

(30) Foreign Application Priority Data

Mar. 11, 2014 (JP) ..... 2014-047796

(51) Int. Cl.
*B41J 2/045* (2006.01)
*B41J 25/34* (2006.01)
*B41J 2/175* (2006.01)

(52) U.S. Cl.
CPC ..... *B41J 2/04501* (2013.01); *B41J 2/17566* (2013.01)

(58) Field of Classification Search
CPC ..... B41J 2/17566; B41J 2/17513; B41J 2/17546; B41J 2/1752; B41J 2/175; B41J 2/17526; B41J 19/202; B41J 2/1755; B41J 2/17503; B41J 2/125; B41J 2/17543
USPC ..... 347/7, 14, 19, 37, 40, 84–86
See application file for complete search history.

(56) References Cited

U.S. PATENT DOCUMENTS

2011/0164077 A1 7/2011 Masunaga
2012/0306950 A1 12/2012 Kobayashi et al.
2013/0002743 A1 1/2013 Masunaga
2013/0057604 A1 3/2013 Masunaga et al.
2013/0127937 A1 5/2013 Masunaga et al.
2013/0135368 A1 5/2013 Kobayashi et al.
2013/0135401 A1 5/2013 Kobayashi et al.
2013/0147867 A1 6/2013 Kobayashi et al.

FOREIGN PATENT DOCUMENTS

JP 2011-207206 10/2011
WO WO 2011111759 A1 * 9/2011

* cited by examiner

*Primary Examiner* — Thinh Nguyen
(74) *Attorney, Agent, or Firm* — Cooper & Dunham LLP

(57) ABSTRACT

An image forming apparatus includes an apparatus body, a recording head, head tanks, a carriage, main tanks, a liquid feeder, a liquid feed controller, a displacement member, a carriage-side sensor, and a body-side sensor. The liquid feed controller controls the carriage-side sensor to detect the displacement member of each head tank during a single scan of the carriage; obtains a current position of the displacement member; determines a liquid amount in each head tank or adjustment operation of the liquid amount based on both a comparison result of the current position and a determination position and a detection result of the carriage-side sensor, the determination position calculated from a detection position of the displacement member detected with the carriage-side sensor and set within a range in which the carriage-side sensor detects the displacement member; controls the feeder in accordance with a determination result; and adjusts the liquid amount.

13 Claims, 15 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-047796, filed on Mar. 11, 2014 in the Japan Patent Office, the entire disclosure of which is hereby incorporated by reference herein.

BACKGROUND

1. Technical Field

Embodiments of this disclosure relate to an image forming apparatus, and more specifically to an image forming apparatus including a recording head for discharging liquid droplets and a head tank for supplying liquid to the recording head.

2. Description of the Related Art

Image forming apparatuses are used as printers, facsimile machines, copiers, plotters, or multifunction peripherals having two or more of the foregoing capabilities. As one type of image forming apparatus employing a liquid discharge recording method, inkjet recording apparatuses are known that use a recording head (liquid discharge head or droplet discharge head) for discharging droplets of ink or other liquid.

To replenish and supply liquid from a main tank to a head tank (also referred to as "sub tank") mounted on the recording head even during printing operation, such an image forming apparatus may have a displacement member (hereinafter also referred to as "feeler") mounted on the head tank and displaceable with the remaining amount of liquid in the head tank, a first sensor (carriage-side detector) mounted on a carriage to detect that the displacement member is at a predetermined first position, and a second sensor (body-side detector) mounted on an apparatus body to detect that the displacement member is at a predetermined second position. The image forming apparatus detects and stores a differential supply amount corresponding to a displacement amount of the displacement member between the first position and the second position. In supplying liquid from the main tank to the head tank without using the second sensor on the apparatus body, the image forming apparatus supplies liquid to the head tank by the differential supply amount after detection of the displacement member with the first sensor.

SUMMARY

In at least one embodiment of the present disclosure, there is provided an improved image forming apparatus including an apparatus body, a recording head, plural head tanks, a carriage, plural main tanks, a liquid feeder, a liquid feed controller, a displacement member, a carriage-side sensor, and a body-side sensor. The recording head discharges droplets of liquid. The plural head tanks supply the liquid to the recording head. The carriage mounts the recording head and the head tanks. The plural main tanks contain the liquid. The liquid feeder is communicated with the head tanks to feed the liquid from the main tanks to the head tanks. The liquid feed controller is connected to the liquid feeder to control the liquid feeder to feed the liquid from the main tanks to the head tanks. The displacement member is disposed on each of the head tanks to displace with a remaining amount of the liquid in each of the head tanks. The carriage-side sensor is disposed on the carriage to detect the displacement member. The body-side sensor is disposed on the apparatus body to detect the displacement member. The liquid feed controller controls the carriage to scan and the carriage-side sensor to detect the displacement member of each of the head tanks during a single scan of the carriage; obtains a current position of the displacement member of each of the head tanks; determines one of an amount of the liquid in each of the head tanks and adjustment operation of the amount of the liquid based on both a comparison result of the current position and a predetermined determination position and a detection result of the carriage-side sensor, the determination position calculated from a detection position of the displacement member detected with the carriage-side sensor and set within a range in which the carriage-side sensor detects the displacement member; controls driving of the liquid feeder in accordance with a determination result of the one of the amount of the liquid and the adjustment operation; and adjusts the amount of the liquid in each of the head tanks.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
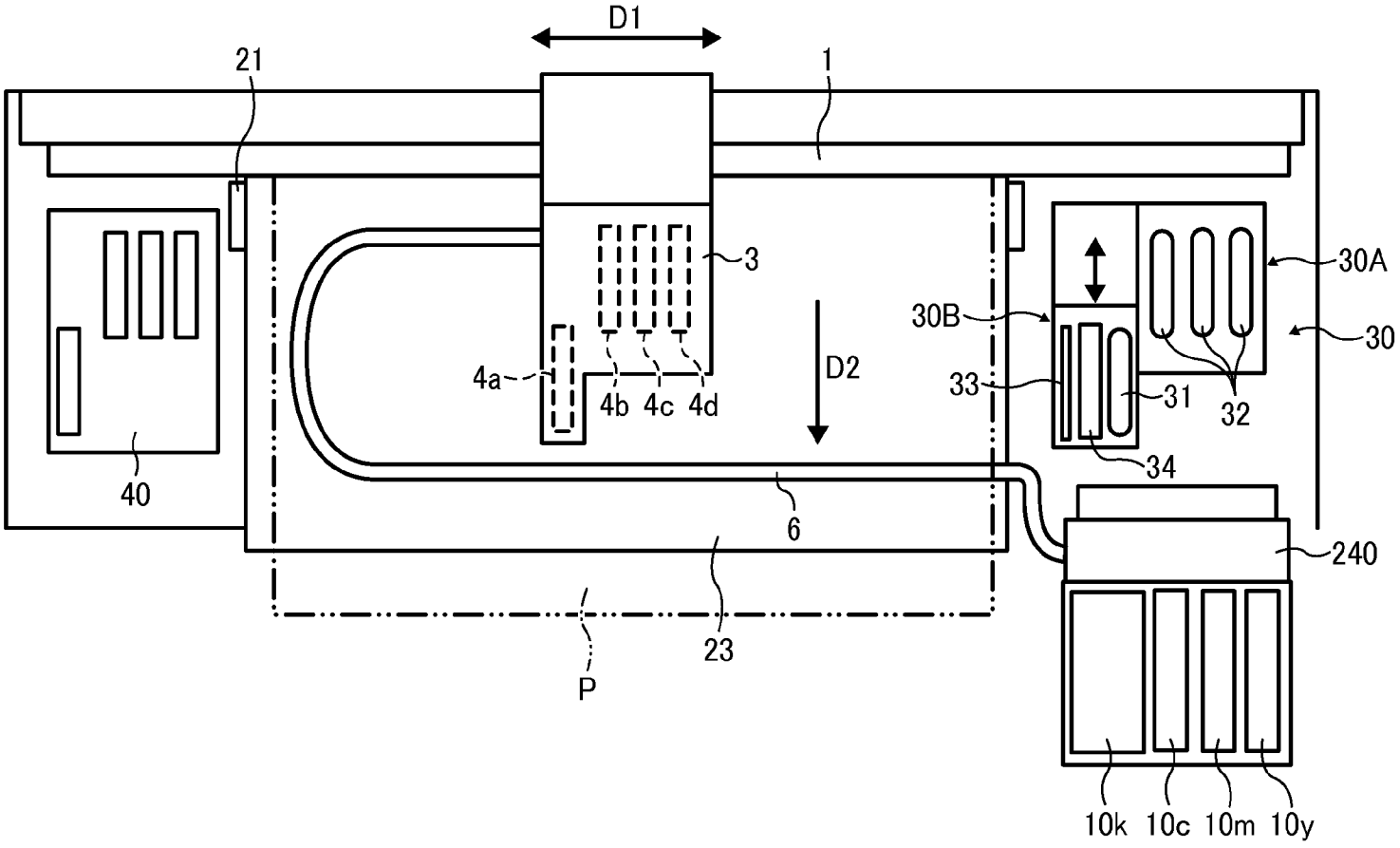
FIG. 1 is a side view of a mechanical section of an image forming apparatus according to at least one embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
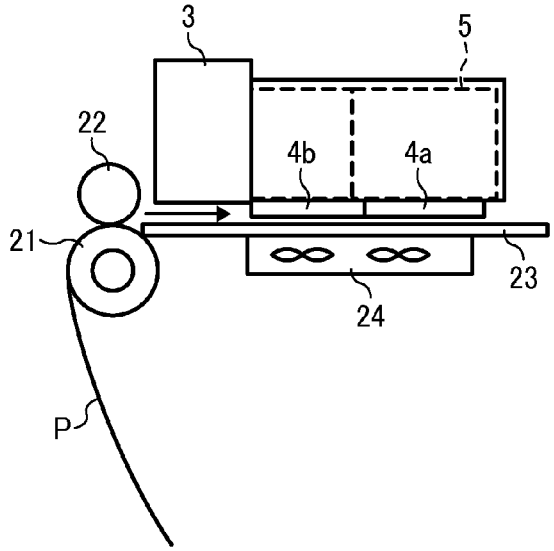
FIG. 2 is a partial plan view of the mechanical section of FIG. 1.

First, an image forming apparatus according to an embodiment of this disclosure is described with reference to FIGS. 1 and 2. FIG. 1 is a partial plan view of a mechanical section of an image forming apparatus according to an embodiment of this disclosure. FIG. 2 is a partial side view of the mechanical section of FIG. 1.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another. The term "image formation" is used as a synonym for "recording" or "printing".

The term "image forming apparatus" refers to an apparatus that discharges liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

In this embodiment, the image forming apparatus is a serial-type image forming apparatus. In the image forming apparatus, a carriage 3 is supported by a main guide rod 1 and a sub guide rod so as to be movable in a direction (main scanning direction) indicated by arrow D1 in FIG. 1. The main guide rod 1 and the sub guide rod extend between left and right side plates. A main scanning motor 554 reciprocally moves the carriage 3 for scanning in the main scanning direction D1 via a timing belt extending between a driving pulley and a driven pulley.

The carriage 3 mounts recording heads 4*a*, 4*b*, 4*c*, and 4*d* (collectively referred to as "recording heads 4" unless distinguished) serving as four liquid discharge heads for discharge liquid droplets. The carriage 3 mounts the recording heads 4 so that nozzle rows, each of which includes multiple nozzles, are arranged in parallel to a sub scanning direction (indicated by arrow D2 in FIG. 1) perpendicular to the main scanning direction D1 and ink droplets are discharged downward from the nozzles.

On the carriage 3, the recording head 4*a* is displaced from the recording heads 4*b*, 4*c*, and 4*d* by one head (one nozzle row) in the sub-scanning direction D2 perpendicular to the main scanning direction Dl. Each of the recording heads 4*a* to 4*d* has two nozzle rows. Each of the recording heads 4*a* and 4*b* discharges liquid droplets of the same color, black. The recording heads 4*c* and 4*d* discharge liquid droplets of magenta (M), cyan (C), and yellow (Y).

The recording heads 4*a* to 4*d* are provided with respective head tanks 5 to supply liquid to the corresponding recording heads 4. Different color inks are supplied from ink cartridges 10*k*, 10*c*, 10*m*, and 10*y* to the head tanks 5 via supply tubes 6. The ink cartridges 10 serve as main tanks replaceably mounted on an apparatus body 101. To the two recording heads 4*a* and 4*b* for discharging the same color of droplets, ink is supplied from the ink cartridge 10*k*.

Liquid feed pumps 241 for the respective ink cartridges 10 are provided in a liquid feed pump unit 240 to feed liquid from the ink cartridges 10 to the head tanks 5.

The image forming apparatus also includes a conveyor opposing the recording heads 4 to attract a rolled sheet P and convey the rolled sheet P with the sheet P attached thereon. The conveyor includes, e.g., a conveyance roller 21, a pressure roller 22, a platen 23, and a suction fan 24. The conveyance roller 21 conveys the rolled sheet P to a position opposing the recording heads 4. The pressure roller 22 is pressed by and contacts the conveyance roller 21. The platen 23 is disposed at a position opposing the recording heads 4. The suction fan 24 sucks the rolled sheet P via suction holes of the platen 23 to attract the rolled sheet P onto the platen 23.

The image forming apparatus further includes a maintenance assembly (maintenance and recovery assembly) 30 at one side in the main scanning direction D1 to maintain and recover the recording heads 4, and a first dummy discharge receptacle 40 at the opposite side to receive liquid droplets discharged during dummy discharge in which liquid droplets not contributing to image formation are discharged from the recording heads 4.

The maintenance assembly 30 serving as a maintenance unit and includes a first maintenance device 30A supported by the apparatus body 101 and a second maintenance device 30B supported by the apparatus body 101 so as to be reciprocally movable in the sub-scanning direction indicated by arrow D2 in FIG. 1. When maintenance or recovery operation is performed on the recording head 4*a*, the second maintenance device 30B is placed at a position illustrated in FIG. 1. When maintenance or recovery operation is performed on one of the recording heads 4*b* to 4*d*, the second maintenance device 30B is moved to the same position as the position of the first maintenance device 30A in FIG. 1 in the sub scanning direction D2.

The maintenance assembly 30 includes, for example, a suction cap 31 and moisture-retention caps 32. The suction cap 31 caps a nozzle face (nozzle formed face) of any one of the recording heads 4 to suck liquid from the nozzle face. The suction cap 31 and the moisture-retention caps 32 cap the nozzle faces of the recording heads 4 for moisture retention. The maintenance assembly 30 also includes a wiper member 33 to wipe the nozzle faces of the recording heads 4 and a second dummy discharge receptacle 34 to receive liquid droplets not contributing to image formation and discharged from the recording heads 4 during dummy discharge.

For the image forming apparatus having the above-described configuration, a rolled sheet P is fed from a sheet feeder and conveyed in the sub-scanning direction D2 by the conveyance roller 21 and the pressure roller 22 while being attached on the platen 23.

By driving the recording heads 4 in accordance with image signals while moving the carriage 3 in the main scanning direction Dl, liquid droplets are discharged onto the rolled sheet P, which is stopped below the recording heads 4, to form one line of a desired image. After the rolled sheet P is fed by a certain distance, another line of the image is recorded. Such operations are repeated and the rolled sheet P is sequentially output.

Figure 3:
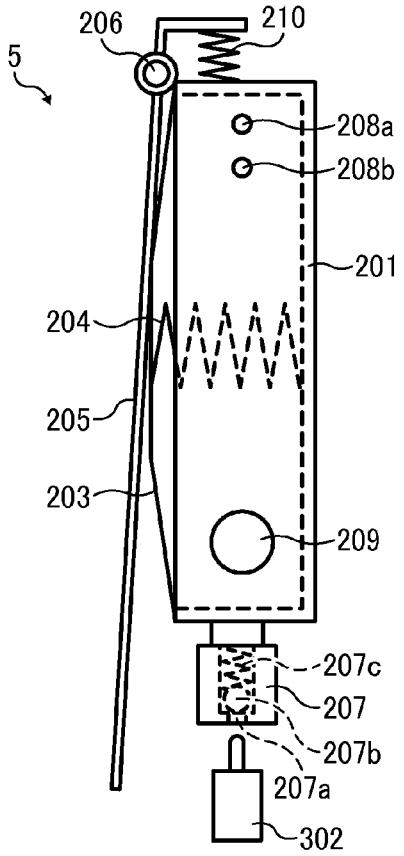
FIG. 3 is a schematic plan view of an example of a head tank of the image forming apparatus.
Figure 4:
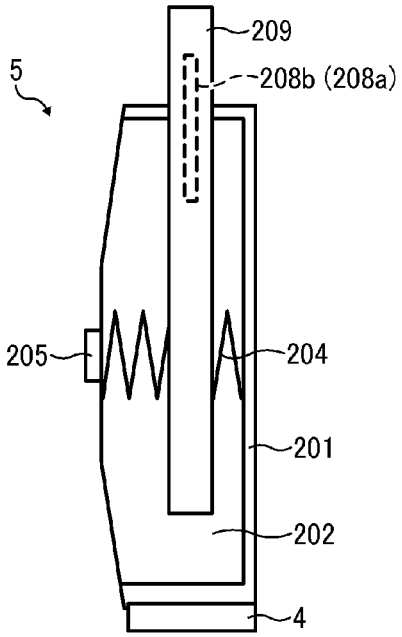
FIG. 4 is a schematic front cross sectional view of the head tank illustrated in FIG. 3.

Next, an example of the head tank 5 is described with reference to FIGS. 3 and 4. FIG. 3 is a schematic plan view of the head tank 5. FIG. 4 is a schematic front view of the head tank 5 of FIG. 3.

The head tank 5 has a tank case 201 including an ink containing part 202 to contain ink and having an opening at one side. The opening of the tank case 201 is sealed with a film 203 serving as a flexible member to form the ink containing part 202. The film 203 is constantly urged outward by a restoring force of a spring 204 serving as an elastic member disposed in the tank case 201.

Thus, since the restoring force of the spring 204 acts on the film 203 of the tank case 201, a decrease in the remaining amount of ink in the ink containing part 202 of the tank case 201 creates a negative pressure.

At the exterior of the tank case 201, a displacement member (hereinafter, may also be referred to as simply "feeler") 205 formed with a feeler having one end swingably supported by a shaft 206 is fixed on the film 203 by, e.g., adhesion. The displacement member 205 is urged toward the tank case 201 by a spring 210 and displaces with movement of the film 203. Accordingly, the displacement member 205 displaces with movement of the film 203.

The displacement member 205 is detected with, e.g., a carriage sensor (first sensor) 251 serving as a carriage-side detector mounted on the carriage 3 or a body sensor (second sensor) 301 serving as a body-side detector disposed at the apparatus body 101, thus allowing detection of the remaining amount of ink or negative pressure in the head tank 5.

A supply port portion 209 is disposed at an upper portion of the tank case 201 and connected to a supply tube 6 to supply ink from an ink cartridge 10. At one side of the tank case 201, an air release unit 207 is disposed to release the interior of the head tank 5 to the atmosphere.

The air release unit 207 includes an air release passage 207*a* communicating with the interior of the head tank 5, a valve body 207*b* to open and close the air release passage 207*a*, and a spring 207*c* to urge the valve body 207*b* into a closed state. An air release solenoid 302 is disposed at the apparatus body 101, and the valve body 207*b* is pushed by the air release solenoid 302 to open the air release passage 207*a*, thus causing the interior of the head tank 5 to be opened to the atmosphere (in other words, causing the interior of the head tank 5 to communicate with the atmosphere).

The head tank 5 are provided with electrode pins 208*a* and 208*b* serving as a liquid level detector to detect a liquid level of ink in the head tank 5. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink has decreased to a threshold level or lower.

Figure 5:
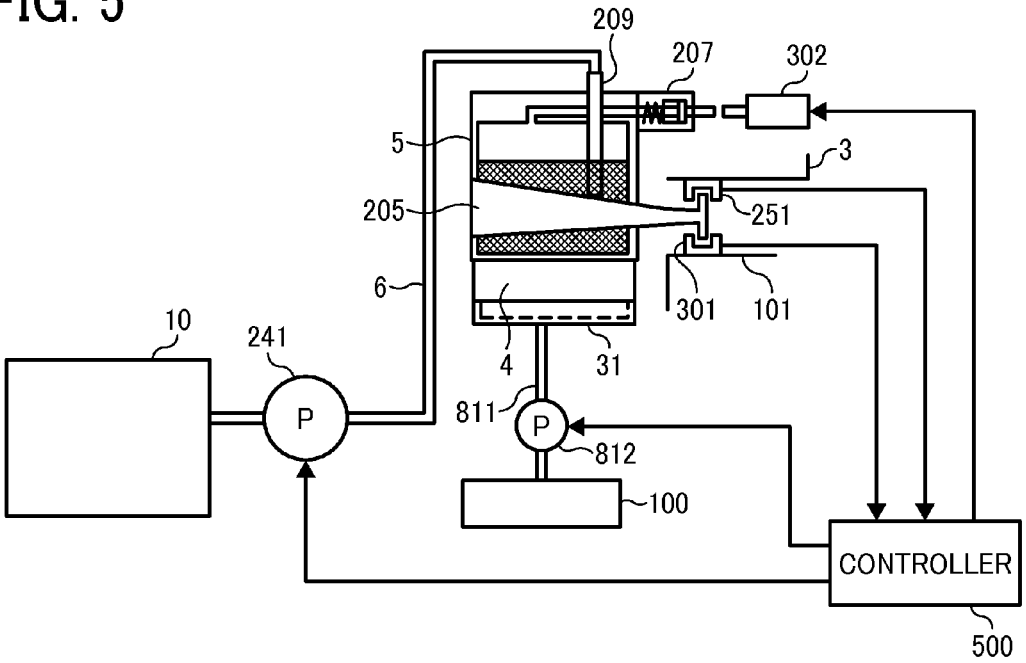
FIG. 5 is a schematic view of an ink supply-and-discharge system of the image forming apparatus.
Figure 6:
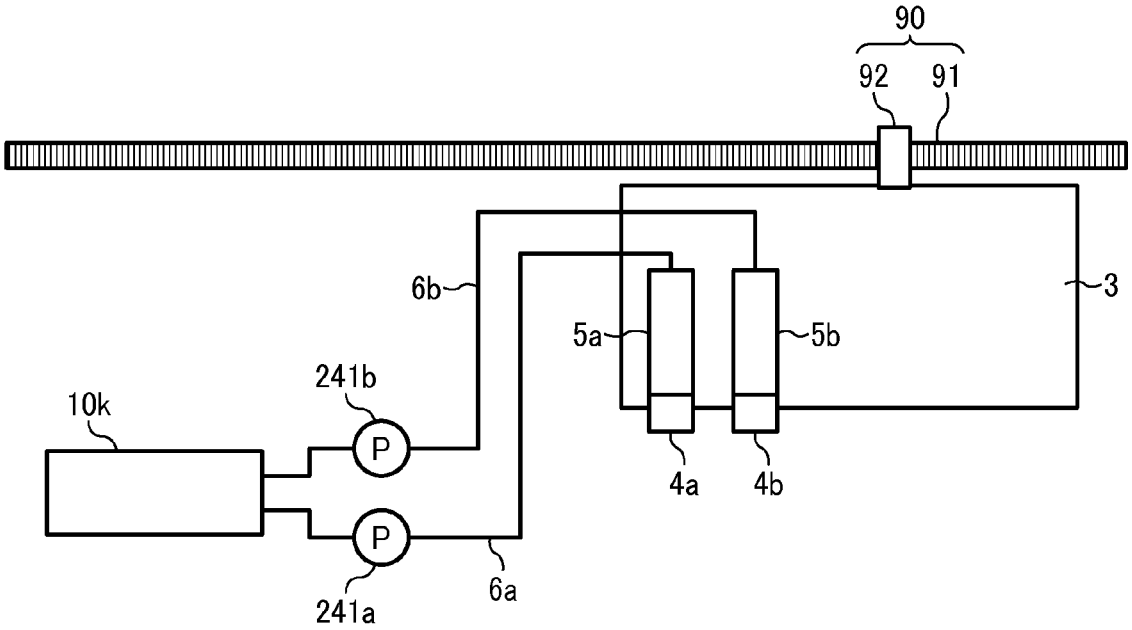
FIG. 6 is a schematic view of a supply system for two recording heads to discharge liquid droplets of the same color.

Next, an ink supply-and-discharge system of the image forming apparatus is described with reference to FIGS. 5 and 6. FIG. 5 is a schematic view of the supply-and-discharge system. FIG. 6 is a schematic view of a supply system for two recording heads to discharge liquid droplets of the same color.

A liquid feed pump 241 serving as a liquid feeder supplies ink from the ink cartridge 10 (hereinafter, main tank) to the head tank 5 via the supply tube 6. The liquid feed pump 241 is a reversible pump (reversible liquid feeder), e.g., a tube pump, capable of performing normal feed operation to supply ink from the ink cartridge 10 to the head tank 5 and reverse feed operation to return ink from the head tank 5 to the ink cartridge 10.

In this embodiment, as illustrated in FIG. 6, the same color of ink is supplied from a single main tank (ink cartridge) 10*k* to two head tanks 5*a* and 5*b* for the recording heads 4*a* and 4*b*. Liquid feed pumps 241*a* and 241*b* supply ink to the head tanks 5*a* and 5*b* via supply tubes 6*a* and 6*b*.

As described above, the maintenance assembly 30 includes the suction cap 31 to cap a nozzle face of any one of the recording heads 4 and a suction pump 812 connected to the suction cap 31. The suction pump 812 is driven with the nozzle face capped with the suction cap 31 to suck ink from the nozzles via a suction tube 811, thus allowing ink to be sucked from the head tank 5. Waste ink sucked from the head tank 5 is discharged to a waste liquid tank 100.

The air release solenoid 302 serving as a pressing member to open and close the air release unit 207 of the head tank 5 is disposed at the apparatus body 101. By activating the air release solenoid 302, the air release unit 207 can be opened.

An encoder scale 91 disposed at the apparatus body and an encoder sensor 92 mounted on the carriage 3 form a main scanning encoder 90 serving as a linear encoder to detect a position (carriage position) of the carriage 3.

The carriage 3 is provided with the carriage sensor 251 serving as a carriage-side detector including an optical sensor to detect the displacement member 205. The apparatus body 101 is provided with the body sensor 301 serving as a body-side detector including an optical sensor to detect the displacement member 205.

Ink supply operation to the head tank 5 is controlled based on detection results of the carriage sensor 251 and the body sensor 301.

A controller 500 performs driving control of the liquid feed pump 241, the air release solenoid 302, and the suction pump 812 and the ink supply control according to embodiments of this disclosure.

Figure 7:
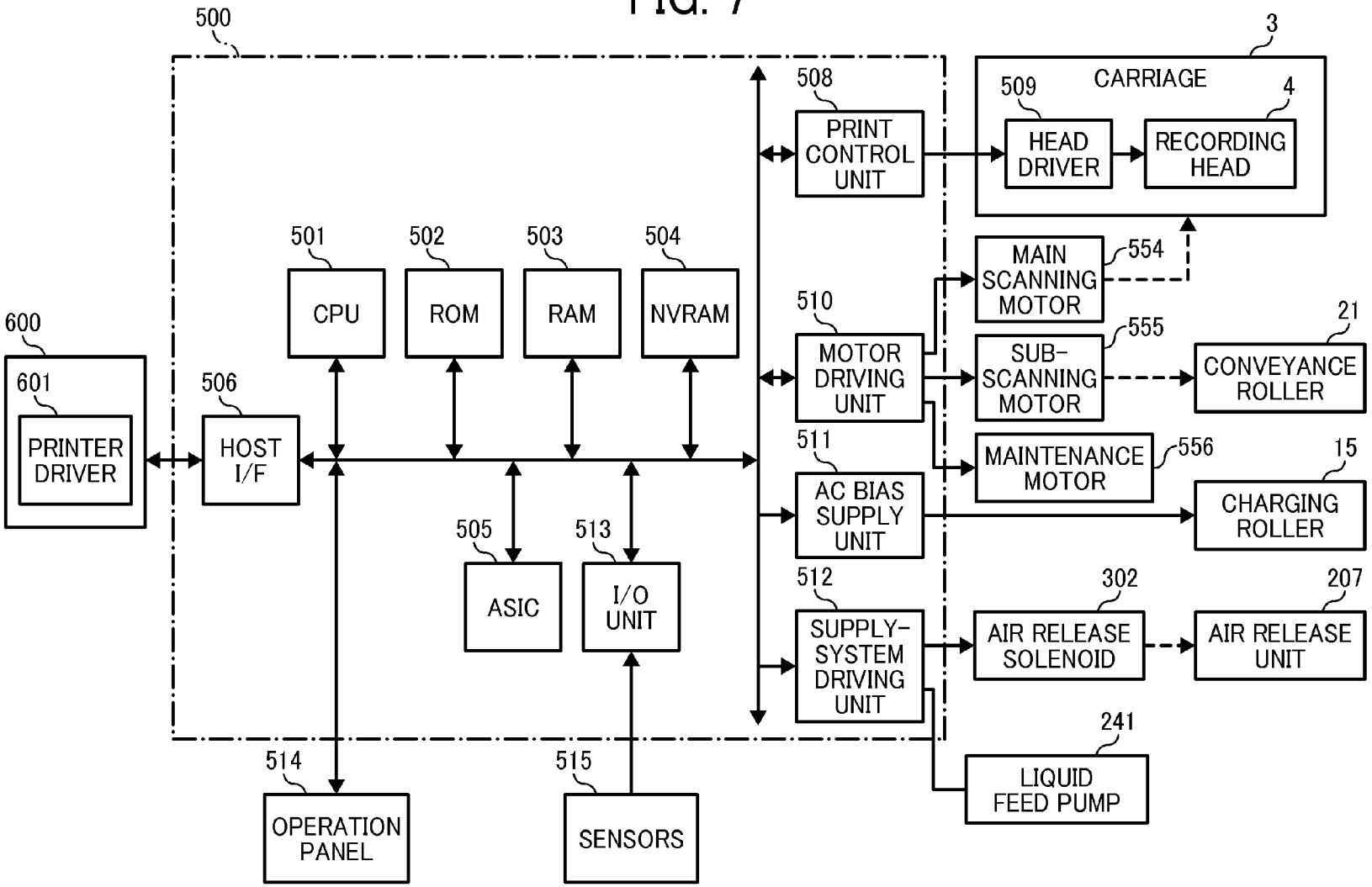
FIG. 7 is a block diagram of a controller of the image forming apparatus.

Next, an outline of the controller 500 of the image forming apparatus is described with reference to FIG. 7. FIG. 7 is a block diagram of the controller 500 of the image forming apparatus.

The controller 500 includes a central processing unit (CPU) 501 a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and serves as various control units including a liquid feed controller according to embodiments of this disclosure. The ROM 502 stores programs executed by the CPU 501 and other fixed data, and the RAM 503 temporarily stores image data and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508 and a head driver (driver integrated circuit) 509. The print control unit 508 includes a data transmitter and a driving signal generator to drive and control the recording heads 4. The head driver 509 drives the recording heads 4 mounted on the carriage 3.

The controller 500 further includes a main scanning motor 554, a sub scanning motor 555 and a motor driving unit 510. The main scanning motor 554 moves the carriage 3 for scanning, and the sub-scanning motor 555 rotates the conveyance roller 21. The motor driving unit 510 drives a maintenance motor 556 of the maintenance assembly 30. The controller 500 further includes an AC bias supply unit 511, an air release solenoid 302, and a supply-system driving unit 512. The AC bias supply unit 511 supplies AC bias to the charging roller 15. The air release solenoid 302 is disposed at the apparatus body 101 to open and close the air release units 207 of the head tanks 5. The supply-system driving unit 512 drives the liquid feed pumps 241.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), via a cable or network.

The CPU 501 of the controller 500 reads and analyzes print data stored in a reception buffer of the I/F 506, performs desired image processing, data sorting, or other processing with the ASIC 505, and transfers image data from the print control unit 508 to the head driver 509. A printer driver 601 of the host 600 creates dot-pattern data for image output.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier. The print control unit 508 outputs a driving signal containing one or more driving pulses from the driving signal generator to the head driver 509.

In accordance with serially-inputted image data corresponding to one image line recorded by the recording heads 4, the head driver 509 selects driving pulses forming driving signals transmitted from the print control unit 508 and applies the selected driving pulses to driving elements (e.g., piezoelectric elements) to drive the recording heads 4. The driving elements serve as pressure generators to generate energy for discharging liquid droplets from the recording heads 4. At this time, by selecting a part or all of the driving pulses forming the driving signals, the recording heads 4 can selectively discharge different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the motor driving unit 510, and ink supply to the head tanks 5 based on the extracted information.

The group of sensors 515 include the carriage sensor 251, the body, and the detection electrode pins 208*a* and 208*b*. The group of sensors 515 include, for example, an optical sensor to detect a position of a sheet of recording media, a thermistor (environment temperature and/or humidity sensor) to monitor temperature and/or humidity in the apparatus, a voltage sensor to monitor the voltage of the charged belt, and an interlock switch to detect the opening and closing of a cover. The I/O unit 513 is capable of processing various types of information transmitted from the group of sensors.

Next, detection of the displacement member 205 of the head tank 5 with the carriage sensor 251 is described with reference to FIGS. 8A and 8B.

Figure 8A:
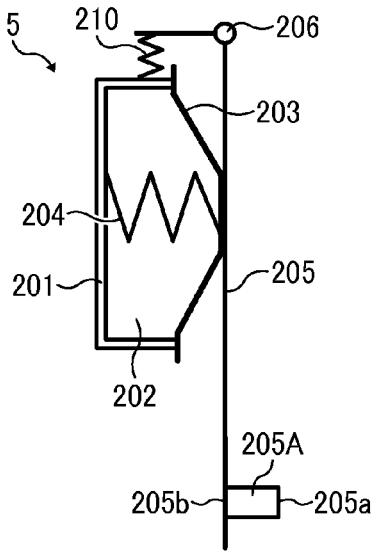
FIGS. 8A and 8B are schematic views of a displacement member of the head tank and detection of the displacement member with a carriage sensor.
Figure 8B:
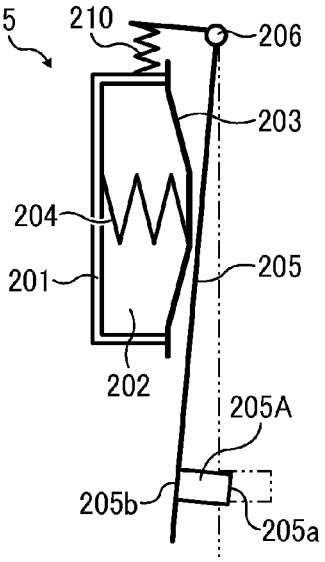

As liquid in the head tank 5 is consumed, the displacement member 205 of the head tank 5 displaces, for example, from a position illustrated in FIG. 8A to a position indicated by a solid line in FIG. 8B. As liquid is supplied to the head tank 5, the displacement member 205 displaces to the position illustrated in FIG. 8A.

Here, as illustrated in FIGS. 8A and 8B, a detected portion 205A of the displacement member 205 detected with the carriage sensor 251 has a certain thickness in a displacement direction of the displacement member 205. The detected portion 205A of the displacement member 205 has an outer edge 205*a* at a side opposite a side at which the tank case 201 is disposed, and an inner edge 205*b* at the side at which the tank case 201 is disposed.

Liquid feed control for the head tank 5 is performed based on detection of the outer edge 205*a* of the displacement member 205 with the carriage sensor 251.

Next, detection of a current position of the displacement member 205 are described with reference to FIGS. 9A and 9B.

When the body sensor 301 detects the displacement member 205 with scanning of the carriage 3, a detecting position (carriage position) of the main scanning encoder 90 is a current position of the displacement member 205.

Figure 9A:
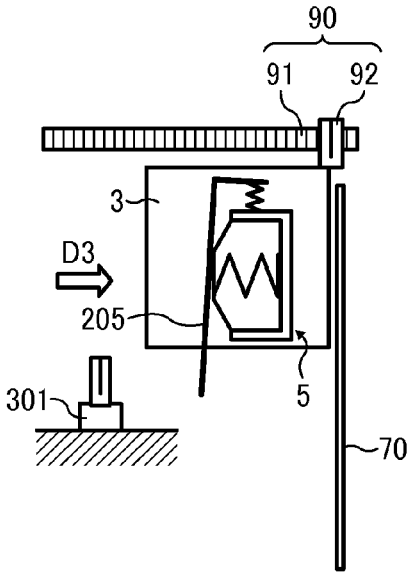
FIGS. 9A and 9B are schematic views of detection of a current position of the displacement member.

In other words, as illustrated in FIG. 9A, by homing operation (operation of determining a home position of the carriage 3), the carriage 3 is moved in a direction indicated by arrow D3 to contact a side plate 70. At this time, the position of the carriage 3 detected with the main scanning encoder 90 is set to the home position HP (indicated by "0").

Figure 9B:
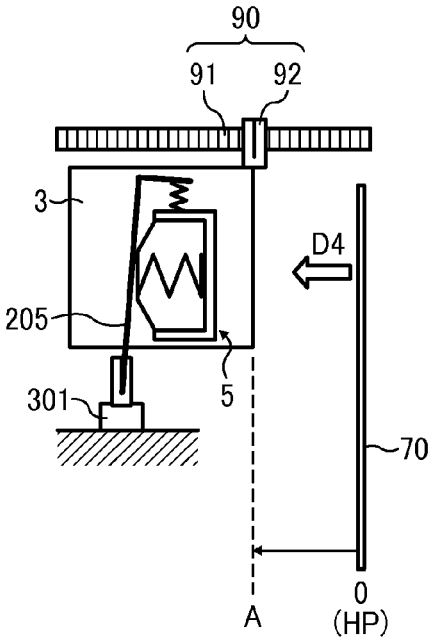

Then, as illustrated in FIG. 9B, the carriage 3 is moved in a direction indicated by arrow D4, and a head tank feeler position detecting operation is performed to detect the displacement member 205 with the body sensor 301. When the body sensor 301 detects the displacement member 205, the main scanning encoder 90 detects a position A of the carriage 3, thus obtaining the current position of the displacement member 205.

Figure 10:
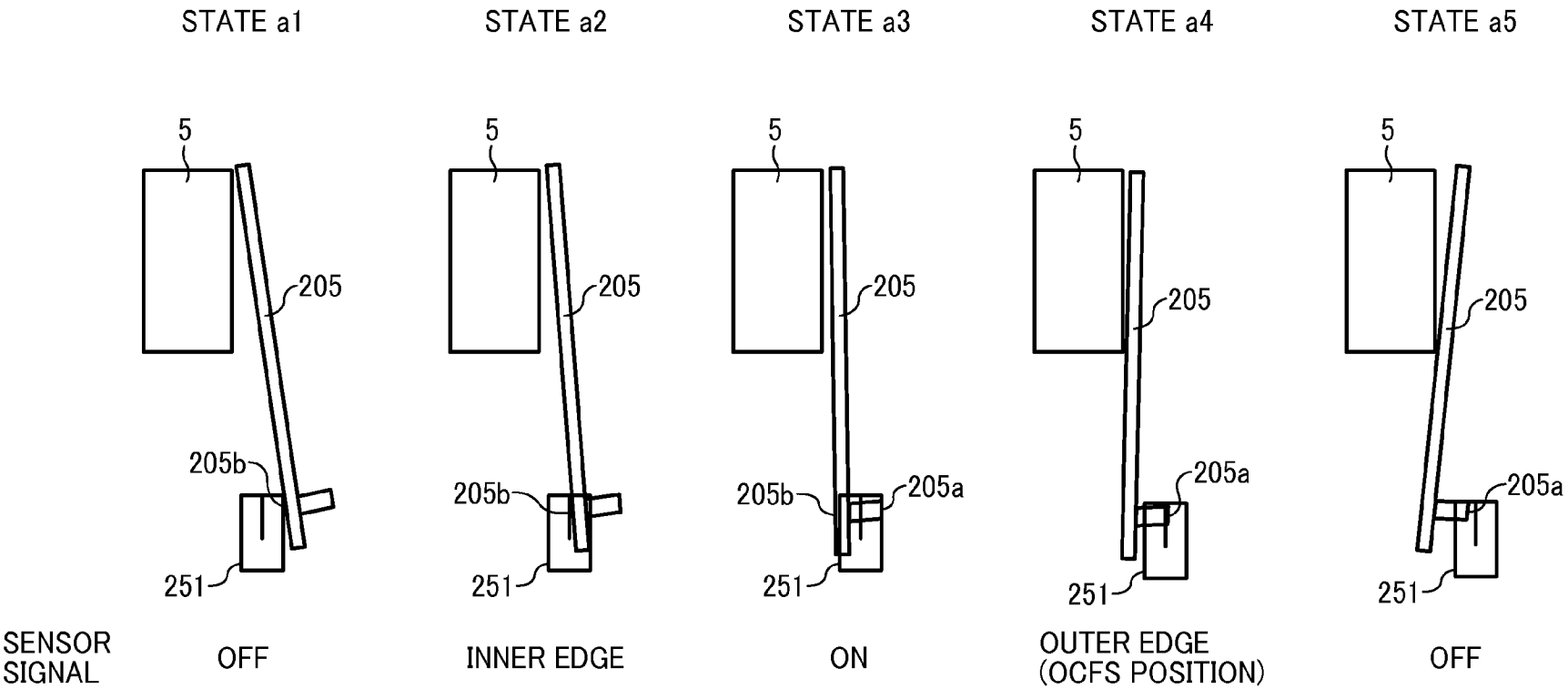
FIG. 10 are schematic views of positions of the displacement member of the head tank and detection results of the carriage sensor.

Next, positions of the displacement member 205 of the head tank 5 and detection results of the carriage sensor 251 are described with reference to FIG. 10. In FIG. 10, the displacement member 205 and the carriage sensor 251 are illustrated in transmission state for convenience.

In a state a1 of FIG. 10, the remaining amount of liquid in the head tank 5 is large, and the inner edge 205*b* of the displacement member 205 is displaced in an opening direction (direction away from the carriage sensor 251) beyond the carriage sensor 251. The carriage sensor 251 is turned OFF (non-detection state).

In a state a2 of FIG. 10, the inner edge 205*b* of the displacement member 205 of the head tank 5 is detected with the carriage sensor 251, and the carriage sensor 251 is turned on (detection state). When the displacement member 205 moves from an open state (a state in which the remaining amount of liquid is large) in a closing direction (a direction in which the remaining amount of liquid decreases), a signal of the carriage sensor 251 transits from OFF to ON. When the displacement member 205 moves from a closed state (a state in which the remaining amount of liquid is small) to an opening direction (a direction in which the remaining amount of liquid increases), the signal of the carriage sensor 251 transits from ON to OFF.

In a state a3 of FIG. 10, the displacement member 205 of the head tank 5 is detected with the carriage sensor 251, and the carriage sensor 251 is turned ON.

In a state a4 of FIG. 10, the outer edge 205*a* of the displacement member 205 is detected with the carriage sensor 251, and the carriage sensor 251 is turned ON. Hereinafter, this position is referred to as OCFS (on-carriage feeler sensor) position. When the displacement member 205 moves from the open state (the state in which the remaining amount of liquid is large) in the closing direction (the direction in which the remaining amount of liquid decreases), the signal of the carriage sensor 251 transits from ON to OFF. When the displacement member 205 moves from the closed state (the state in which the remaining amount of liquid is small) to the opening direction (the direction in which the remaining amount of liquid increases), the signal of the carriage sensor 251 transits from OFF to ON.

In a state a5 of FIG. 10, the remaining amount of liquid in the head tank 5 is small, and the outer edge 205*a* of the displacement member 205 is displaced in the closing direction (direction toward the carriage sensor 251) beyond the carriage sensor 251. The carriage sensor 251 is turned OFF.

Next, supply control to the head tank and adjustment control of the amount of liquid in a first embodiment of this disclosure is described with reference to FIG. 11. States a1 to a5 illustrated in (a) of FIG. 11 correspond to the states a1 to a5, respectively, of FIG. 10.

First, in normal printing operation, supply control is performed based on the OCFS position.

In other words, when the carriage sensor 251 transits from the detection state in which the carriage sensor 251 detects the displacement member 205 to the non-detection state in which the carriage sensor 251 doesn't detect the outer edge 205*a* (from ON to OFF), measurement of the consumption amount of liquid is started. As illustrated in (b) of FIG. 11, when the liquid consumption amount reaches a predetermined consumption amount W, the controller 500 starts feeding liquid from the main tank 10 to the head tank 5.

As a result, the displacement member 205 of the head tank 5 displaces in the opening direction away from the tank case 201, and the carriage sensor 251 detects the outer edge 205*a* of the displacement member 205 (transits from OFF to ON).

Figure 11:
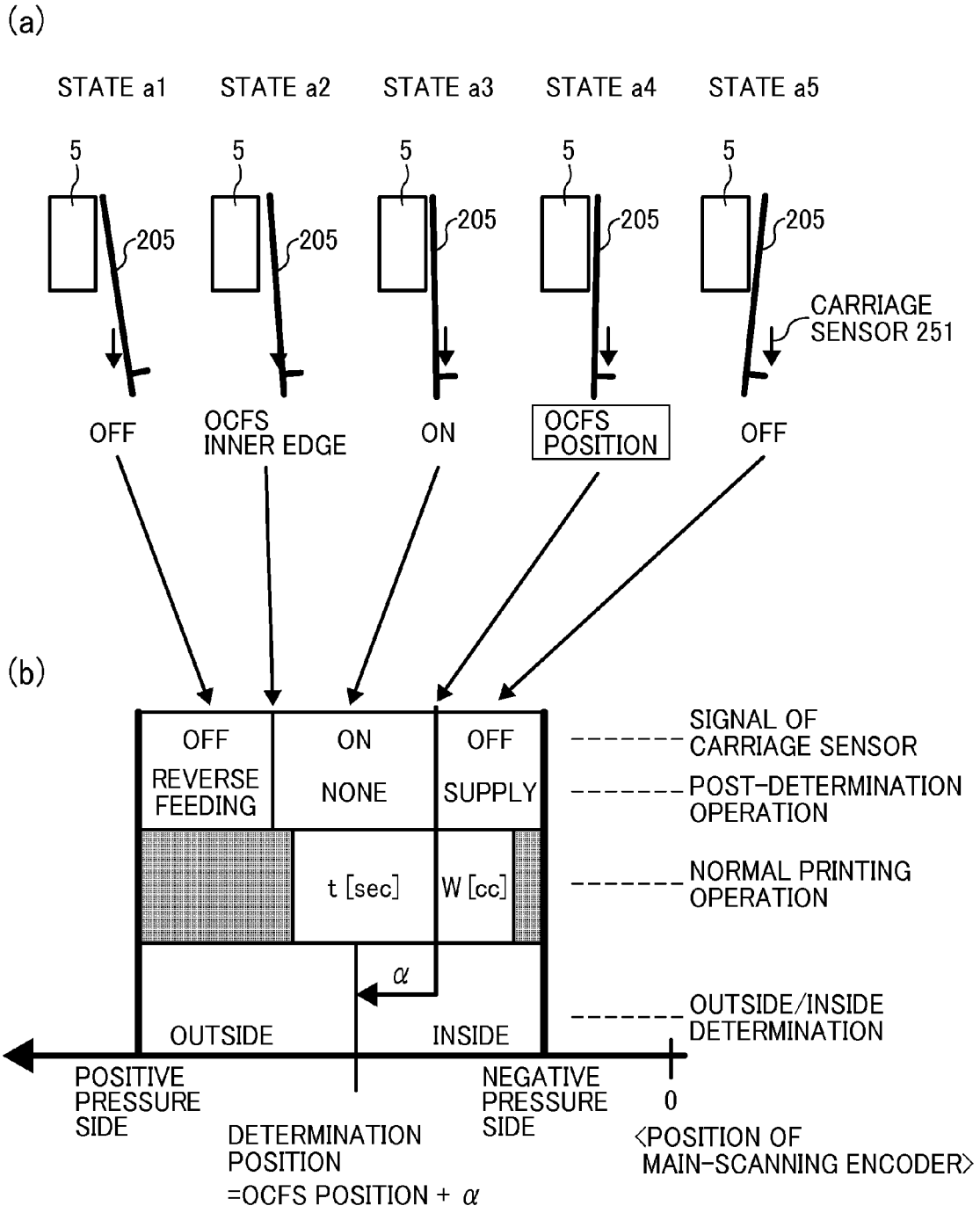
FIG. 11 is a diagram of supply control to the head tank and adjustment control of the amount of liquid in a first embodiment of this disclosure.

Then, as illustrated in (b) of FIG. 11, from detection of the outer edge 205*a* of the displacement member 205 with the carriage sensor 251, the controller 500 feeds liquid by a predetermined target liquid feed amount. The target liquid feed amount is controlled based on driving time (supply time) t [scc] of the liquid feed pump 241.

Here, the target liquid feed amount (driving time t) is set to not greater than an amount of liquid fed until the carriage sensor 251 detects the inner edge 205*b* from detection of the outer edge 205*a* of the displacement member 205. In other words, the target liquid feed amount is set to be not greater than an amount corresponding to a displacement amount in which the carriage sensor 251 continues detecting the displacement member 205.

Next, at a timing other than normal printing operation, for example, when the power is turned on or after a print job is finished, the controller 500 obtains the position of the displacement member 205 of the head tank 5 to perform adjustment control of adjusting the amount of liquid in the head tank 5.

For the adjustment control, the carriage 3 is scanned to the home position side to obtain a current position of the displacement member 205 of each head tank 5 with the body sensor 301 during one scanning.

The controller 500 compares the current position of the carriage 3 obtained with the body sensor 301 and a predetermined determination position within a range in which the carriage sensor 251 detects the displacement member 205, and determines the amount of liquid or adjustment operation of the amount of liquid of each head tank 5 based on the comparison results and detection results of the displacement member 205 with the carriage sensor 251 (ON/OFF date of the carriage sensor).

Here, the comparison of the determination position with the current position is performed because the position of the displacement member 205 is unclear when the carriage sensor 251 does not detect the displacement member 205, i.e., the carriage sensor 251 is turned OFF.

Thus, by comparing the determination position with the current position, the controller 500 determines whether the displacement member 205 is placed at an open position outer than (outside) or in a closed position inner than (inside) the carriage sensor 251.

Here, the determination position is set in the vicinity of a midpoint between the OCFS position and the detecting position of the inner edge 205*b*. Since the thickness of the detected portion 205A of the displacement member 205 is previously obtained, the determination position is calculated by adding a difference a to the OCFS position.

At this time, for example, fluctuations of the displacement member 205, sensor detection errors, errors in the detecting direction of the sensor are sufficiently smaller than the thickness of the detected portion 205A of the displacement member 205. Accordingly, the controller 500 can reliably determine whether the carriage sensor 251 is OFF with the displacement member 205 closed (at the inside at which the remaining amount of liquid is smaller than at a position at which the displacement member 205 is detected with the carriage sensor 251) or open (at the outside at which the remaining amount of liquid is greater than at the position at which the displacement member 205 is detected with the carriage sensor 251).

Thus, as illustrated in (b) of FIG. 11, when the carriage sensor 251 detects the displacement member 205 (is turned ON), the controller 500 determines that the amount of liquid in the head tank 5 is appropriate, and does not drive the liquid feed pump 241, in other words, does not perform adjustment operation (no operation after determination).

By contrast, when it is determined that the carriage sensor 251 is off with the displacement member 205 placed at the inside at which the remaining amount of liquid is smaller than at the position at which the displacement member 205 is detected with the carriage sensor 251, in other words, the amount of liquid in the head tank 5 is smaller than an appropriate range, the controller 500 drives the liquid feed pump 241 for forward rotation to feed liquid from the main tank 10 to the head tank 5.

By contrast, when it is determined that the carriage sensor 251 is off with the displacement member 205 placed at the outside at which the remaining amount of liquid is greater than at the position at which the displacement member 205 is detected with the carriage sensor 251, in other words, the amount of liquid in the head tank 5 is greater than the appropriate range, the controller 500 drives the liquid feed pump 241 for reverse rotation to feed liquid in reverse from the head tank 5 to the main tank 10.

As described above, when the carriage 3 is scanned, the body sensor 301 detects a current position of the displacement member 205 of each of the multiple recording heads 4 in turn to obtain the current position of the displacement member 205. Based on both a comparison result of the current position and a predetermined determination position calculated from the detection position (the outer edge 205*a*) of the carriage sensor 251 detected with the displacement member 205, the predetermined determination position being within a range in which the carriage sensor 251 detects the displacement member 205 and the detection result of the carriage sensor 251, the controller 500 determines adjustment operation of the amount of liquid for each head tank 5, controls driving of the liquid feed pump 241 communicated with each head tank 5, and adjusts the amount of liquid in each head tank 5. In some embodiments, the controller 500 determines whether the amount of liquid is large or small. The controller 500 feeds liquid forward or in reverse in accordance with the determination results. Alternatively, the controller 500 determines that the amount of liquid is appropriate, and does not perform adjustment operation.

Such a configuration reduces the time for adjustment of the amount of liquid in the plurality of head tanks and shortens the time for printing preparation.

Next, adjustment control according to a second embodiment of the present disclosure is described with reference to FIG. 12.

This embodiment relates to adjustment operation performed when the current position of the displacement member 205 obtained with the body sensor 301 is at a side at which the remaining amount of liquid is greater than at the determination position and the carriage sensor 251 is in OFF state in which the carriage sensor 251 does not detect the displacement member 205.

Figure 12:
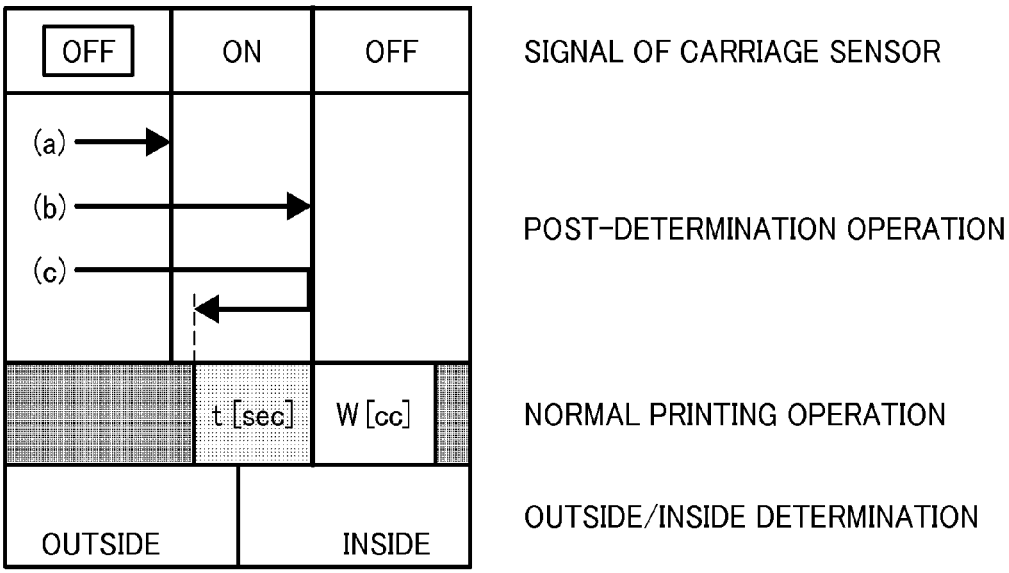
FIG. 12 is a chart of adjustment control according to a second embodiment of this disclosure.

In such a case, as illustrated in (a) of FIG. 12, the controller 500 controls the liquid feed pump 241 to feed liquid in reverse until the carriage sensor 251 detects the displacement member 205.

Alternatively, as illustrated in (b) of FIG. 12, the controller 500 controls the liquid feed pump 241 to feed liquid in reverse from when the carriage sensor 251 detects the displacement member 205 (the inner edge 205*b*) to when the carriage sensor 251 comes not to detect the displacement member 205 (the outer edge 205*a* comes off the outer edge 205*a*).

Alternatively, as illustrated in (c) of FIG. 12, the controller 500 controls the liquid feed pump 241 to feed liquid in reverse from when the carriage sensor 251 detects the displacement member 205 to when the carriage sensor 251 comes not to detect the displacement member 205, and then feed liquid forward by a predetermined target liquid feed amount (for a driving time t).

For such a configuration, by performing adjustment operation illustrated in (b) or (c) of FIG. 12, the amount of liquid in the head tank 5 is maintained within a range of target liquid feed amount. The target liquid feed amount includes a margin relative to the detecting position of the inner edge 205*b*. However, since the inner edge 205*b* may correspond to an amount of liquid detected with the carriage sensor 251, adjustment operation of (a) of FIG. 12 may be performed.

Next, adjustment control according to a third embodiment of the present disclosure is described with reference to FIG. 13.

This embodiment relates to adjustment operation performed when the current position of the displacement member 205 obtained with the body sensor 301 is at a side at which the remaining amount of liquid is smaller than at the determination position and the carriage sensor 251 is in OFF state in which the carriage sensor 251 does not detect the displacement member 205.

Figure 13:
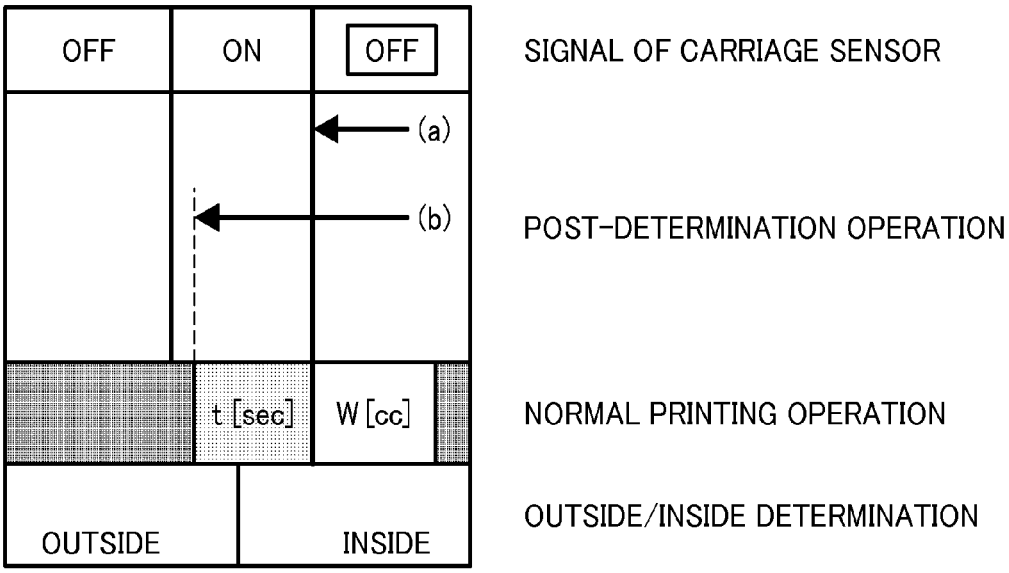
FIG. 13 is a chart of adjustment control according to a third embodiment of this disclosure.

In such a case, as illustrated in (a) of FIG. 13, the controller 500 controls the liquid feed pump 241 to feed liquid forward until the carriage sensor 251 detects the outer edge 205*a* of the displacement member 205.

Alternatively, as illustrated in (c) of FIG. 13, after the carriage sensor 251 detects the outer edge 205*a* of the displacement member 205, the controller 500 controls the liquid feed pump 241 to feed liquid forward by a predetermined target liquid feed amount (for a driving time t).

Such control allows the amount of liquid in the head tank 5 to be maintained within a range of target liquid feed amount.

Next, adjustment control according to a fourth embodiment of the present disclosure is described with reference to FIG. 14.

This embodiment relates to adjustment operation performed when the carriage sensor 251 is in ON state in which the carriage sensor 251 detects the displacement member 205.

Figure 14:
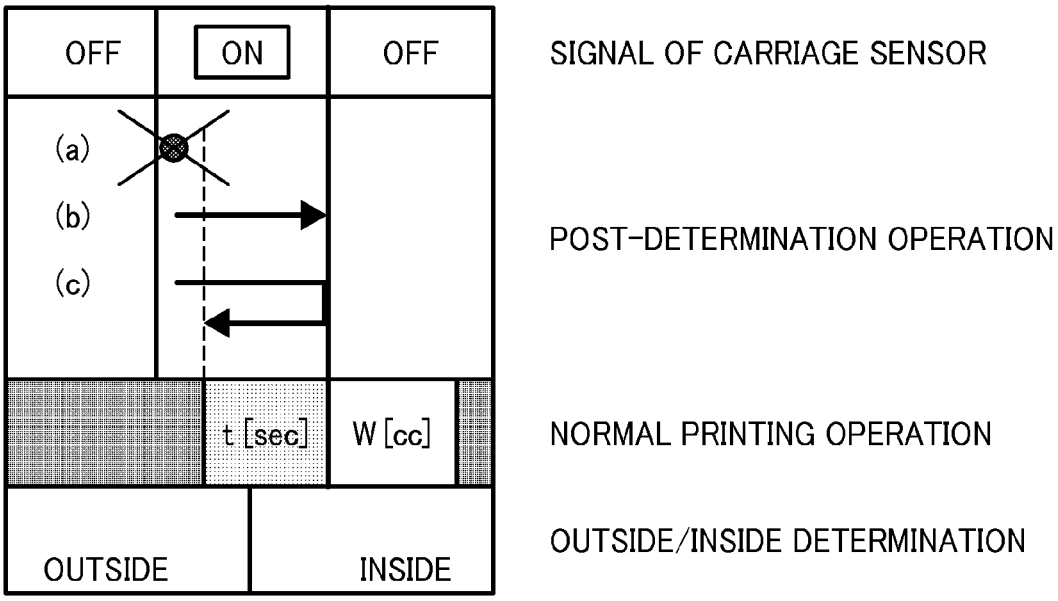
FIG. 14 is a chart of adjustment control according to a fourth embodiment of this disclosure.

In such a case, as illustrated in (a) of FIG. 14, the controller 500 does not control the liquid feed pump 241 to feed liquid forward or in reverse.

Alternatively, as illustrated in (b) of FIG. 14, the controller 500 controls the liquid feed pump 241 to feed liquid in reverse until the carriage sensor 251 comes not to detect the displacement member 205 (or detects the outer edge 205*a*).

Alternatively, as illustrated in (c) of FIG. 14, the controller 500 controls the liquid feed pump 241 to feed liquid in reverse until the carriage sensor 251 comes not to detect the displacement member 205 (or detects the outer edge 205*a*), and then feed liquid forward by a predetermined target liquid feed amount (for a driving time t).

Such control allows the amount of liquid in the head tank 5 to be maintained within a range of target liquid feed amount.

Next, general adjustment operation on five head tanks 5*a* to 5*e* corresponding to the four recording heads 4*a* to 4*d* mounted on the carriage 3 is described with reference to FIGS. 15A and 15B.

In this embodiment, the recording heads 4*a*, 4*b*, and 4*c* discharge liquid of black (K1), black (K2), and cyan (C). The recording head 4*d* uses two nozzle rows to discharge yellow (Y) and magenta (M), and the single recording head 4*d* has two head tanks 5*d* and 5*e*.

For such a configuration, the head tanks 5*d* and 5*e* are integrated as a single unit, and the detected portion 205A of the displacement member 205 for yellow is disposed at a side opposite to a side at which the detected portions 205A of the other displacement member 205 are disposed.

Figure 15A:
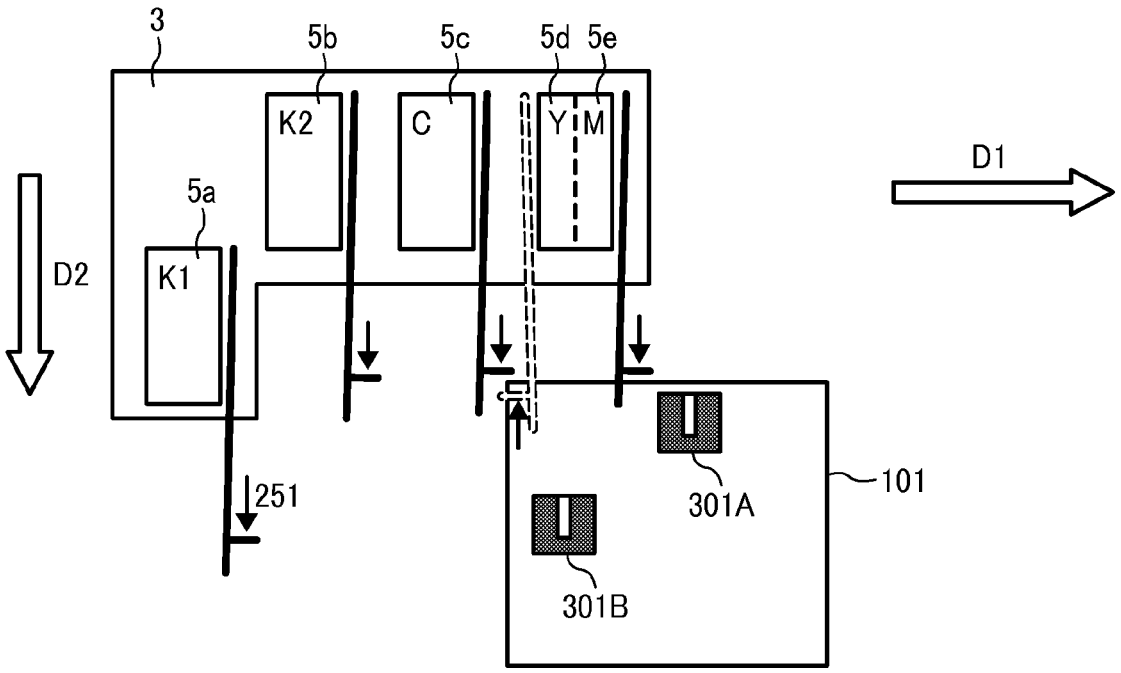
FIG. 15A is a schematic view of adjustment operation in the image forming apparatus.
Figure 15B:
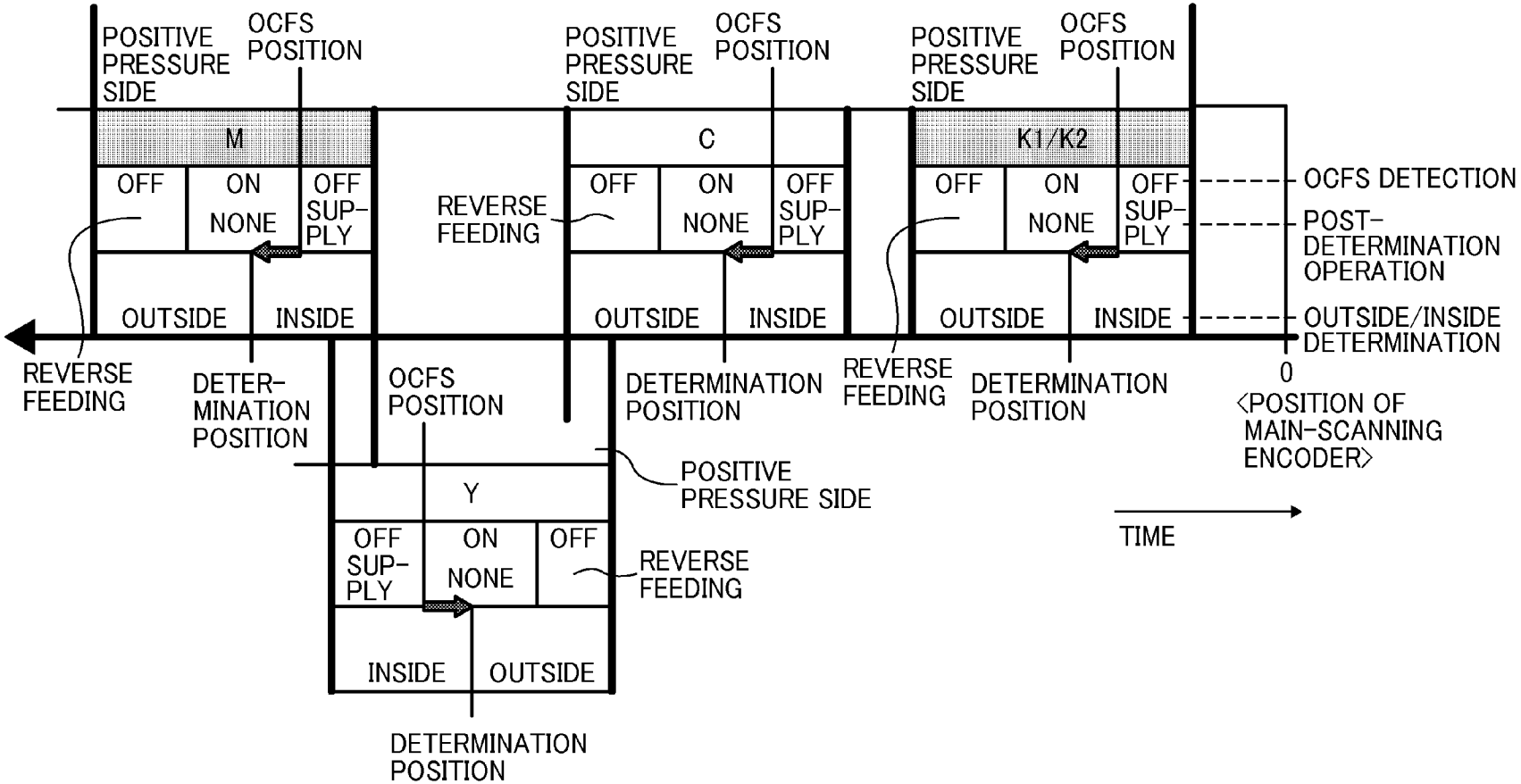
FIG. 15B is a chart of adjustment operation in the image forming apparatus.

The recording head 4*a* is offset from the recording heads 4*b* to 4*d* in the sub-scanning direction indicated by arrow D2 perpendicular to the main scanning direction indicated by arrow D1 in FIG. 15A. Accordingly, body sensors 301A and 301B are arranged on the apparatus body 101 to be offset from each other in the sub-scanning direction D2.

When the carriage 3 is moved for scanning in the main scarring direction (carriage scanning direction) D1, the body sensors 301A and 301B detect current positions of the five head tanks 5*a* to 5*e* of the displacement member 205 during a single scan and determine adjustment operation, for example, in a way described in the above-described first embodiment.

As described above, the controller 500 obtains the current position of the displacement member of each the head tank in a single scanning, determines whether the displacement member is open to the outside or closed to the inside, in other words, determines the amount of liquid in each the head tank (or adjustment operation) based on the current position and detection results of the carriage sensor, and performs adjustment operation in accordance with the determination results, thus reducing the downtime.

Next, disadvantages in detection errors of the carriage position used for detection of the current position of the displacement member in the above-described embodiments are described with reference to FIGS. 16A and 16B.

As described above, as illustrated in FIG. 16A, the position of the carriage 3 detected with the main scanning encoder 90 when the carriage 3 contacts the side plate 70 is set to the home position HP.

Figure 16A:
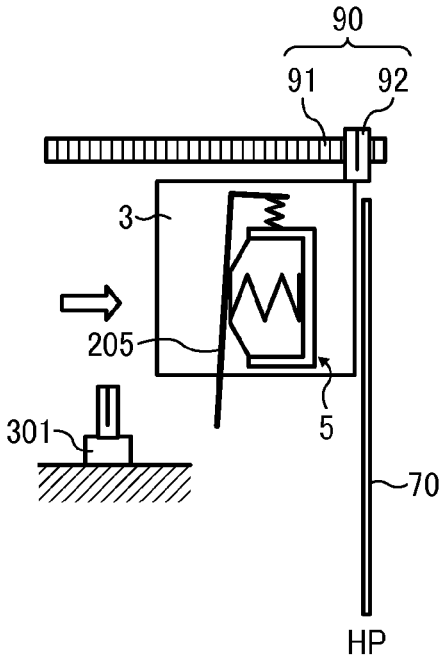
FIGS. 16A and 16B are schematic views of disadvantages in detection errors of a carriage position used for detection of a current position of the displacement member.
Figure 16B:
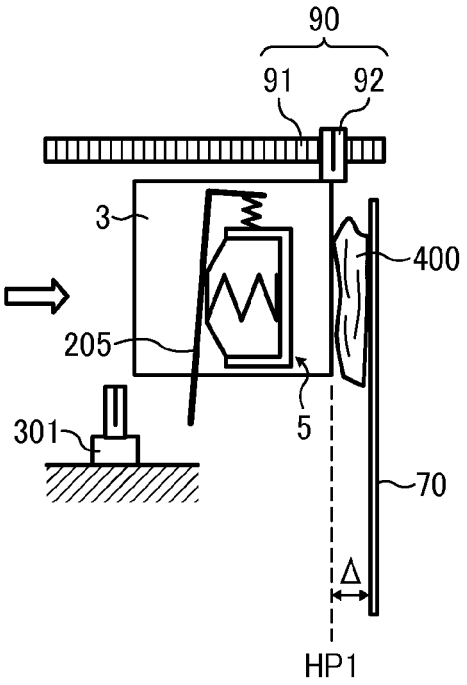

Here, as illustrated in FIG. 16B, if, e.g., an entry of a jammed sheet 400 between the carriage 3 and the side plate 70 or a driving error of the main scanning motor stops the carriage 3 before the carriage 3 contacts the side plate 70, the stop position of the carriage 3 would be set to a home position HP1. As a result, the home position HP has a shift amount of Δ relative to the normal home position HP.

Consequently, as described in the above-described embodiments, in a case in which the displacement member 205 is detected with the body sensor 301 to obtain the current position of the displacement member 205 and it is determined whether the displacement member 205 is open (the amount of liquid is large) or closed (the amount of liquid is small), determination might be reverse.

As a result, for an example of FIGS. 16A and 16B, though the amount of liquid is small, it is determined that the displacement member 205 is open to the outside, and liquid is fed in reverse. In such a case, since the carriage sensor 251 does not detect the displacement member 205, a time-out error would occur, thus causing discharge failures of nozzles.

Alternatively, by contrast, though the amount of liquid is large, it may be determined that the displacement member 205 is closed, and liquid is fed forward. In such a case, since the carriage sensor 251 does not detect the displacement member 205, a time-out error would occur, thus causing liquid leakage due to oversupply.

Figure 17:
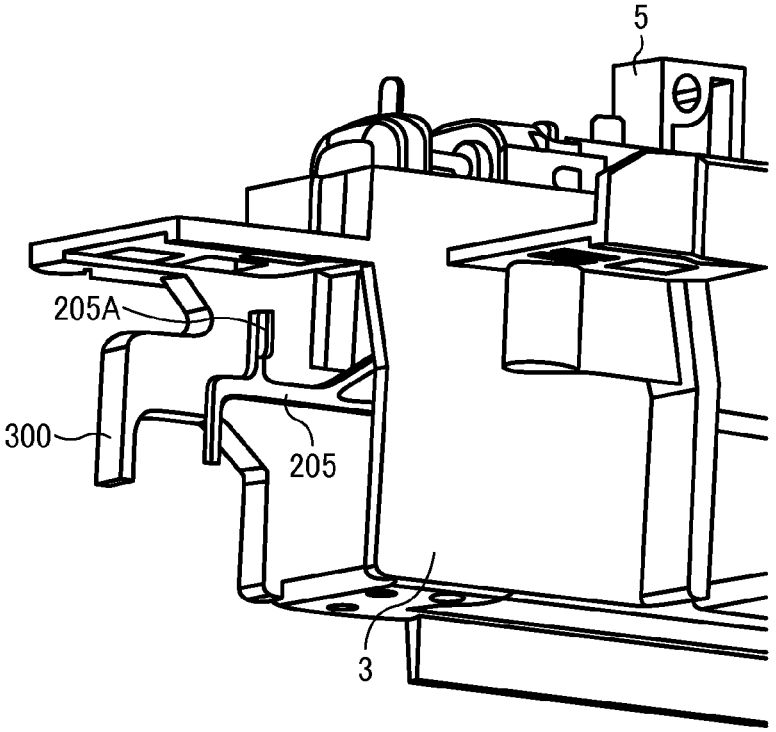
FIG. 17 is a partial perspective view of a carriage in a fifth embodiment of this disclosure.
Figure 18A:
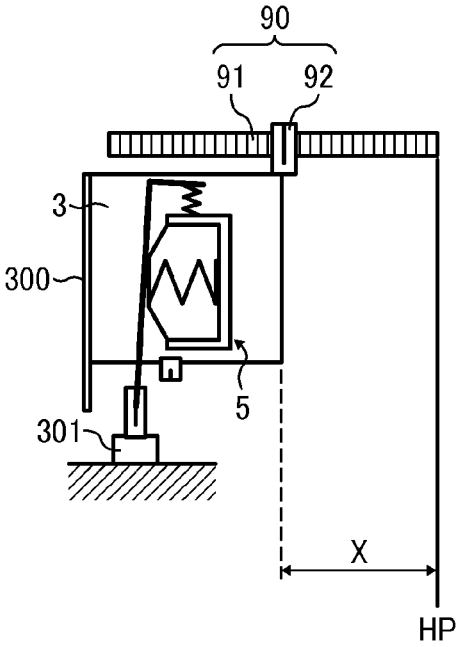
FIGS. 18A and 18B are schematic views of the carriage at a normal home position.
Figure 18B:
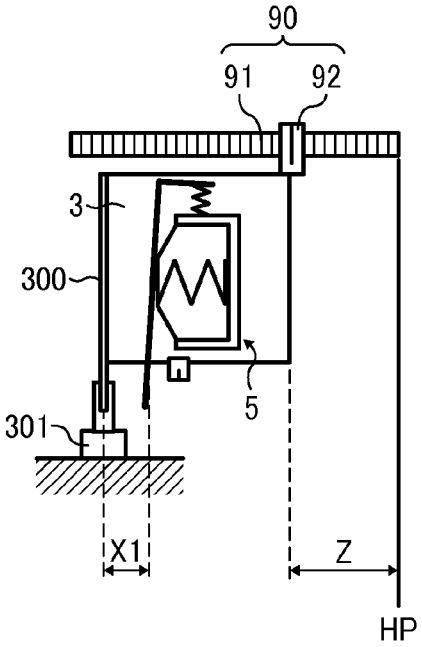
Figure 19A:
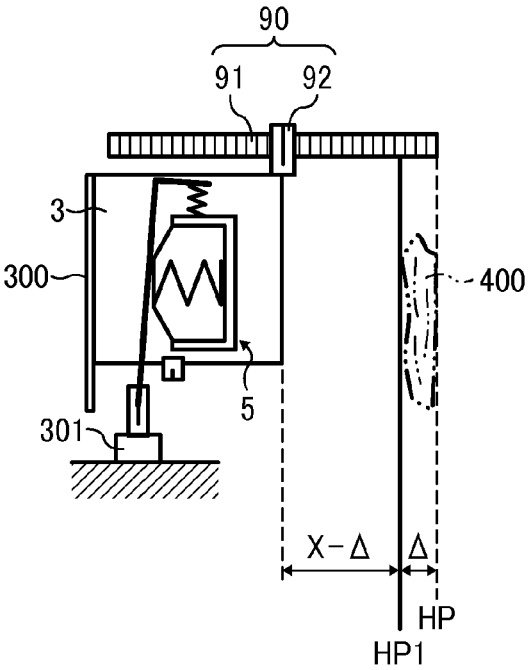
FIGS. 19A and 19B are schematic views of the carriage at a shifted home position.
Figure 19B:
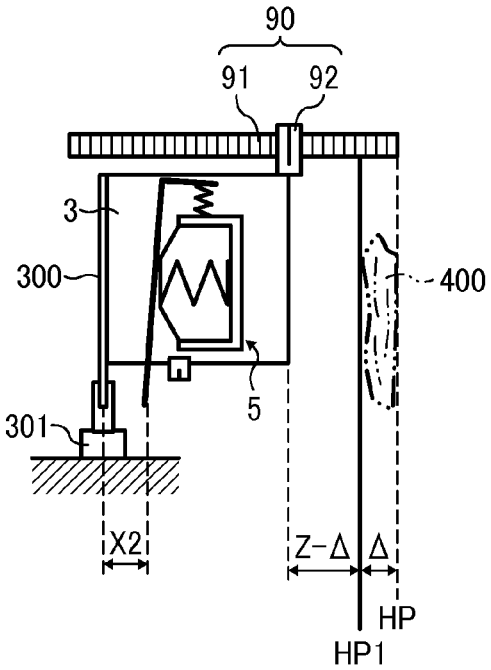

Hence, a fifth embodiment of the present disclosure is described with reference to FIGS. 17 through 19. FIG. 17 is a partial perspective view of a carriage 3 in the fifth embodiment. FIGS. 18A and 18B are schematic views of the carriage 3 at a normal home position. FIGS. 19A and 19B are schematic views of the carriage 3 at a shifted home position.

The carriage 3 is provided with a stationary, immovable detected member (hereinafter, stationary feeler) at a position detectable with a body sensor 301.

A single stationary feeler 300 is provided even when the carriage 3 mounts multiple head tanks 5. Using the single stationary feeler 300 as a reference is advantageous as the relative positions of the head tanks 5 in the carriage 3 do not change. For such a configuration, the reference position data is limited to one piece, which is advantageous in memory space and layout.

Here, as illustrated in FIGS. 18A and 18B, when the normal home position HP is set, a position of the stationary feeler 300 detected with the body sensor 301 is set to a stationary feeler position Z. The stationary feeler 300 and the displacement member 205 of the head tank 5 are detected within a series of operations. A difference between the stationary feeler position Z and the position X of the displacement member 205 of the head tank 5 (referred to as head tank feeler position X) is set as a position X1 of the head tank 5 (X1=X−Z).

In other words, the head tank feeler position X1 determined based on the stationary feeler position Z is used as information on liquid feed control (negative pressure control) to the head tank 5.

The detection in a series of operations means that homing operation (the above-described homing operation by the contact of the carriage 3 against the side plate 70) is not performed between the detection of the stationary feeler position based on the main scanning encoder and the detection of head tank feeler position.

Here, as illustrated in FIGS. 19A and 19B, when the home position HP is set at a position shifted from the normal home position HP by a shift amount Δ, a head tank feeler position X2 based on the stationary feeler position Z is obtained from a difference between the stationary feeler position Z−Δ and the head tank feeler position X−Δ by the following formula: X2=(X−Δ)−(Z−Δ)=X−Z=X1.

In other words, by performing supply control based on the position of the stationary feeler (detected member) 302 of the carriage 3, supply control can be properly performed regardless of a shift of the home position.

The normal home position is, for example, a designed value or a home position of the carriage 3 at a time at which no sheet jam reliably occurs, such as an initial setting of the apparatus or an initial replenishment of liquid to the head.

Next, different examples of a sixth embodiment of the present disclosure are described with reference to FIG. 20. FIGS. 20A and 20B are schematic views of the sixth embodiment.

Figure 20A:
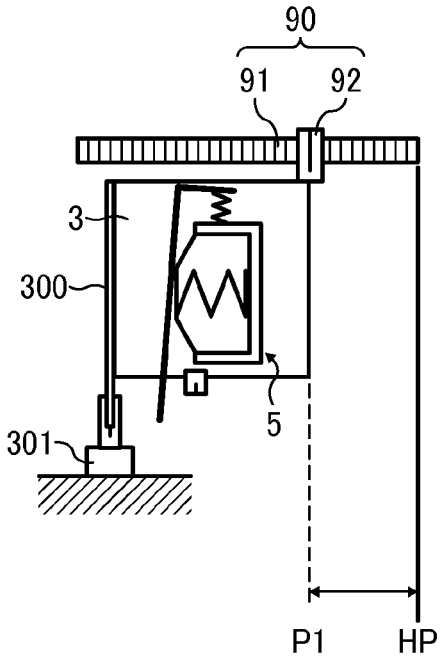
FIGS. 20A and 20B are schematic views of different examples of a sixth embodiment of the present disclosure.

As illustrated in FIG. 20A, when the home position is correct (the carriage position is set to 0 as described above) and the body sensor 301 detects the stationary feeler 300, a position of the carriage 3 detected with the main scanning encoder 90 is set to a position P1.

Figure 20B:
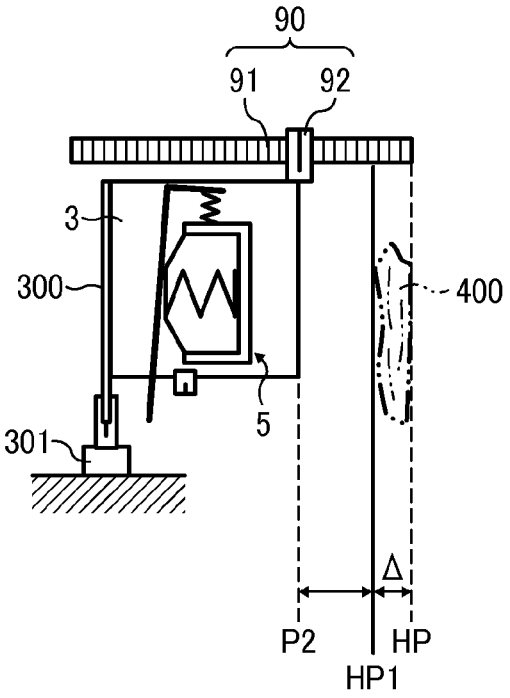

By contrast, as illustrated in FIG. 20B, when a home position HP1 is shifted from the home position HP by a shift amount Δ by a jammed sheet 400 and the body sensor 301 detects the stationary feeler 300, a position of the carriage 3 is set to a position P2.

As a result, a difference between the carriage positions P1 and P2 corresponds to the shift amount Δ.

Hence, for a first example of this embodiment, when the stationary feeler position detected with the body sensor 301 changes a threshold amount or more relative to the stationary feeler position obtained when the home position is correct, in other words, the shift amount Δ is a threshold amount or greater, an error is detected.

In other words, for the detection with the body sensor 301, the stationary feeler 300 vibrates with vibration of the carriage 3, or the body sensor 301 employs a transmissive photosensor with a relatively low detection accuracy. Further, since a difference in data between two positions is calculated, tolerance is accumulated.

By contrast, detection accuracy of the home position (with the main scanning encoder) is high unless abnormality occurs.

Accordingly, as compared to a configuration in which all control is performed based on the stationary feeler 300 of the carriage 3, it is relatively effective that normally, supply accuracy is increased based on the home position, and only on a detection failure of the home position, an error is reported.

Next, for a second example of this embodiment, when the stationary feeler position detected with the body sensor 301 changes a threshold amount or more relative to the stationary feeler position obtained when the home position is correct, in other words, the shift amount Δ is a threshold amount or greater, homing operation is performed.

In other words, when a threshold amount or greater of the shift amount Δ is processed as an error, the image forming apparatus is stopped. Hence, for the second example, homing operation for setting the home position is performed to reduce the time loss.

Hence, for a third example of this embodiment, determination is performed by using a position of the stationary feeler 303 detected with the body sensor 301 as the determination position. When the position of the stationary feeler 303 detected with the body sensor 301 changes a threshold amount or greater relative to a position of the stationary feeler 303 obtained when the home position is correct, in other words, the determination position is corrected by the shift amount Δ.

In other words, since a time loss occurs even in the second example of performing homing operation, the time loss is compensated by correcting the determination position by the shift amount Δ.

Since the determination value is used for determination of the amount of liquid (or adjustment operation) in combination with the state (ON/OFF) of the carriage sensor 251, a high degree of detection accuracy is not necessarily required. Therefore, determination is reliably performed with the above-described correction.

For a head tank having a displacement member, the displacement member may displace due to, for example, slow leakage, evaporation of moisture, and humidity change. Accordingly, if, when a carriage-side detector cannot monitor the displacement member, the displacement member displaces and comes off the carriage-side detector, the position of the displacement member may be uncertain. Therefore, the body-side detector detects the position of the displacement member.

Here, as the number of head tanks mounted on the carriage increases, it may take a longer time to determine the position of the displacement member, thus increasing a time for printing preparation.

Hence, according to at least one of the above-described embodiments of this disclosure, the time for adjusting the amount of liquid in multiple head tanks is effectively reduced.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body;

a recording head to discharge droplets of liquid;

plural head tanks to supply the liquid to the recording head;

a carriage mounting the recording head and the head tanks and scanning in a main scanning direction while the recording head discharges liquid droplets;

plural main tanks to contain the liquid;

a liquid feeder communicated with the head tanks to feed the liquid from the main tanks to the head tanks; and a liquid feed controller connected to the liquid feeder to control the liquid feeder to feed the liquid from the main tanks to the head tanks, a displacement member disposed on each of the head tanks to displace with a remaining amount of the liquid in each of the head tanks;

a carriage-side sensor disposed on the carriage to detect the displacement member;

a body-side sensor disposed on the apparatus body to detect the displacement member;

wherein the liquid feed controller controls the carriage to scan and the carriage-side sensor to detect the displacement member of each of the head tanks during a single scan of the carriage in the main scanning direction, and during said single scan of the carriage in the main scanning direction, obtains a current position of the displacement member of each of the head tanks;

determines one of an amount of the liquid in each of the head tanks and adjustment operation of the amount of the liquid based on both a comparison result of the current position and a predetermined determination position and a detection result of the carriage-side sensor, the determination position calculated from a detection position of the displacement member detected with the carriage-side sensor and set within a range in which the carriage-side sensor detects the displacement member;

controls driving of the liquid feeder in accordance with a determination result of the one of the amount of the liquid and the adjustment operation; and adjusts the amount of the liquid in each of the head tanks, wherein the liquid feeder is a reversible liquid feeder, the liquid feed controller controls the liquid feeder to feed the liquid forward from the main tanks to the head tanks and in reverse from the head tanks to the main tanks, and when the current position of the displacement member is at a side at which a remaining amount of the liquid is smaller than at the determination position and the carriage-side sensor does not detect the displacement member, the liquid feed controller controls the liquid feeder to feed the liquid forward until the carriage-side sensor detects the displacement member.

2. The image forming apparatus according to claim 1, wherein when the current position of the displacement member is at the side at which the remaining amount of the liquid is smaller than at the determination position and the carriage-side sensor does not detect the displacement member, the liquid feed controller controls the liquid feeder to feed the liquid forward by a predetermined target supply amount after the carriage-side sensor detects the displacement member.

3. The image forming apparatus according to claim 1, wherein when the carriage-side sensor detects the displacement member, the liquid feed controller does not control the liquid feeder to feed the liquid forward from the main tanks to the head tanks or in reverse from the head tanks to the main tanks.

4. The image forming apparatus according to claim 1, wherein when the carriage-side sensor detects the displacement member, the liquid feed controller controls the liquid feeder to feed the liquid in reverse from the head tanks to the main tanks until the carriage-side sensor comes not to detect the displacement member.

5. The image forming apparatus according to claim 1, wherein when the carriage-side sensor detects the displacement member, the liquid feed controller controls the liquid feeder to feed the liquid in reverse from the head tanks to the main tanks until the carriage-side sensor comes not to detect the displacement member, and then feed the liquid forward from the main tanks to the head tanks by a predetermined target supply amount.

6. The image forming apparatus according to claim 1, wherein the carriage comprises a detected member detectable with the body-side sensor, wherein the body-side sensor detects the displacement member and the detected member in a series of operations, and the liquid feed controller sets a position of the displacement member relative to a position of the detected member as the current position of the displacement member.

7. The image forming apparatus according to claim 1, wherein the carriage comprises a detected member detectable with the body-side sensor, wherein when a position of the displacement member detected with the body-side sensor shifts by a threshold amount or greater from a reference position of the displacement member obtained when a home position of the carriage is correct, the liquid feed controller determines the position of the displacement member as an error.

8. The image forming apparatus according to claim 1, wherein the carriage comprises a detected member detectable with the body-side sensor, wherein when a position of the displacement member detected with the body-side sensor shifts by a threshold amount or greater from a reference position of the displacement member obtained when a home position of the carriage is correct, the liquid feed controller controls the carriage to move to the home position.

9. The image forming apparatus according to claim 1, wherein the carriage comprises a detected member detectable with the body-side sensor, wherein when a position of the displacement member detected with the body-side sensor shifts by a threshold amount or greater from a reference position of the displacement member obtained when a home position of the carriage is correct, the liquid feed controller corrects the determination position by a shift amount.

10. An image forming apparatus, comprising:

an apparatus body;

a recording head to discharge droplets of liquid;

plural head tanks to supply the liquid to the recording head;

a carriage mounting the recording head and the head tanks and scanning in a main scanning direction while the recording head discharges liquid droplets;

plural main tanks to contain the liquid;

a liquid feeder communicated with the head tanks to feed the liquid from the main tanks to the head tanks; and a liquid feed controller connected to the liquid feeder to control the liquid feeder to feed the liquid from the main tanks to the head tanks, a displacement member disposed on each of the head tanks to displace with a remaining amount of the liquid in each of the head tanks;

a carriage-side sensor disposed on the carriage to detect the displacement member;

a body-side sensor disposed on the apparatus body to detect the displacement member;

wherein the liquid feed controller controls the carriage to scan and the carriage-side sensor to detect the displacement member of each of the head tanks during a single scan of the carriage in the main scanning direction, and during said single scan of the carriage in the main scanning direction, obtains a current position of the displacement member of each of the head tanks;

determines one of an amount of the liquid in each of the head tanks and adjustment operation of the amount of the liquid based on both a comparison result of the current position and a predetermined determination position and a detection result of the carriage-side sensor, the determination position calculated from a detection position of the displacement member detected with the carriage-side sensor and set within a range in which the carriage-side sensor detects the displacement member;

controls driving of the liquid feeder in accordance with a determination result of the one of the amount of the liquid and the adjustment operation;

adjusts the amount of the liquid in each of the head tanks, wherein the liquid feeder is a reversible liquid feeder, the liquid feed controller controls the liquid feeder to feed the liquid forward from the main tanks to the head tanks and in reverse from the head tanks to the main tanks, and when the current position of the displacement member is at a side at which a remaining amount of the liquid is greater than at the determination position and the carriage-side sensor does not detect the displacement member, the liquid feed controller controls the liquid feeder to feed the liquid in reverse until the carriage-side sensor detects the displacement member.

11. The image forming apparatus according to claim 10, wherein when the current position of the displacement member is at a side at which a remaining amount of the liquid is greater than at the determination position and the carriage-side sensor does not detect the displacement member, the liquid feed controller controls the liquid feeder to feed the liquid in reverse until the carriage-side sensor comes not to detect the displacement member after the carriage-side sensor detects the displacement member.

12. An image forming apparatus, comprising:

an apparatus body;

a recording head to discharge droplets of liquid;

plural head tanks to supply the liquid to the recording head;

a carriage mounting the recording head and the head tanks and scanning in a main scanning direction while the recording head discharges liquid droplets;

plural main tanks to contain the liquid;

a liquid feeder communicated with the head tanks to feed the liquid from the main tanks to the head tanks; and a liquid feed controller connected to the liquid feeder to control the liquid feeder to feed the liquid from the main tanks to the head tanks, a displacement member disposed on each of the head tanks to displace with a remaining amount of the liquid in each of the head tanks;

a carriage-side sensor disposed on the carriage to detect the displacement member;

a body-side sensor disposed on the apparatus body to detect the displacement member;

wherein the liquid feed controller controls the carriage to scan and the carriage-side sensor to detect the displacement member of each of the head tanks during a single scan of the carriage in the main scanning direction, and during said single scan of the carriage in the main scanning direction, obtains a current position of the displacement member of each of the head tanks;

determines one of an amount of the liquid in each of the head tanks and adjustment operation of the amount of the liquid based on both a comparison result of the current position and a predetermined determination position and a detection result of the carriage-side sensor, the determination position calculated from a detection position of the displacement member detected with the carriage-side sensor and set within a range in which the carriage-side sensor detects the displacement member;

controls driving of the liquid feeder in accordance with a determination result of the one of the amount of the liquid and the adjustment operation;

adjusts the amount of the liquid in each of the head tanks, wherein the liquid feeder is a reversible liquid feeder, the liquid feed controller controls the liquid feeder to feed the liquid forward from the main tanks to the head tanks and in reverse from the head tanks to the main tanks, and when the current position of the displacement member is at a side at which a remaining amount of the liquid is greater than at the determination position and the carriage-side sensor does not detect the displacement member, the liquid feed controller controls the liquid feeder to feed the liquid in reverse until the carriage-side sensor comes not to detect the displacement member after the carriage-side sensor detects the displacement member, and then feed the liquid forward by a predetermined target supply amount.

13. The image forming apparatus according to claim 12, wherein the target supply amount is not greater than a supply amount of the liquid corresponding to a displacement amount at which the displacement member displaces while the displacement member detects the displacement member.

* * * * *